US008296882B1

(12) United States Patent
Esposito

(10) Patent No.: US 8,296,882 B1
(45) Date of Patent: Oct. 30, 2012

(54) PET SAFETY GUARD FOR A BED

(76) Inventor: Frank Esposito, Rising Sun, MD (US)

( * ) Notice: Subject to any disclaimer, the term of this patent is extended or adjusted under 35 U.S.C. 154(b) by 0 days.

(21) Appl. No.: 13/105,702

(22) Filed: May 11, 2011

(51) Int. Cl.
*A47C 21/08* (2006.01)

(52) U.S. Cl. ..... 5/426; 5/424; 5/425; 5/659; 5/53.1

(58) Field of Classification Search ..... 5/53.1, 5/131, 132, 424–426, 512, 659
See application file for complete search history.

(56) References Cited

U.S. PATENT DOCUMENTS

| | | | | |
|---|---|---|---|---|
| 2,555,228 | A | 5/1951 | Evers | |
| 2,649,594 | A * | 8/1953 | Herz et al. | 5/425 |
| 2,722,693 | A * | 11/1955 | Wolf | 5/426 |
| 2,751,608 | A * | 6/1956 | Lucas | 5/426 |
| 2,854,677 | A * | 10/1958 | Baker et al. | 5/430 |
| 2,859,454 | A | 11/1958 | Beckwell | |
| 2,904,799 | A | 9/1959 | Berlin | |
| 3,402,409 | A | 9/1968 | Kain | |
| 3,616,469 | A | 11/1971 | Injeski | |
| 4,214,327 | A * | 7/1980 | Smith | 5/651 |
| 4,217,670 | A | 8/1980 | Sciongay, Sr. et al. | |
| 4,233,699 | A * | 11/1980 | Amato | 5/426 |
| 4,833,743 | A | 5/1989 | Howell et al. | |
| 6,453,490 | B1 | 9/2002 | Cardinale | |
| 6,952,847 | B1 * | 10/2005 | Cleary | 5/430 |
| 6,957,455 | B1 | 10/2005 | Misson | |
| 7,103,928 | B1 | 9/2006 | Childs | |

FOREIGN PATENT DOCUMENTS

| | | | |
|---|---|---|---|
| EP | 1.593.324 | | 11/2005 |
| GB | 2070921 | A * | 9/1981 |

* cited by examiner

*Primary Examiner* — Michael Trettel
(74) *Attorney, Agent, or Firm* — Michael I. Kroll

(57) ABSTRACT

A plurality of angled members that are positionable between a bed's mattress and box spring to prevent a pet from falling off or of being accidentally pushed off a bed. The angled member positioned at the foot of the bed extends from one side to the other whether twin, queen or king sized mattress with the side angled members positioned on opposing sides of the bed with each adjacently fastened to the foot member by means of at least one bracket. The vertical portion of the angled members sufficiently extends above the planar top surface of the mattress to form a barrier to prevent the aforementioned accidents.

19 Claims, 10 Drawing Sheets

PET SAFETY GUARD FOR A BED

BACKGROUND OF THE INVENTION

1. Field of the Invention

The present invention relates generally to safety shields and, more specifically, to a pet safety device for a bed comprising a polymeric device, such as Plexiglas® or similar material composed of fastenable angular members having a planar base with a vertically extending planar wall, preferably fabricated by bending sheet material into a substantially right angle, with the planar base positionable between a bed's mattress and box spring along the foot and sides of a bed serving as said pet-safety guard.

The vertical portion of the pet-safety guard extends above the height of the mattress forming a barrier wall thereby keeping pets from falling off the bed and injuring themselves.

The side portion extends approximately one third of the distance from the foot of the bed to the headboard.

Regardless of the size of the mattress, the foot portion extends from one side of the bed to the other. The side portions and foot portion are held together by fasteners, which are illustrated as angle brackets but other fasteners may be used serving similar purpose. The pet-safety barrier can be of a transparent, translucent or opaque material and may incorporate a graphic design or pattern thereon.

2. Description of the Prior Art

There are other bed devices designed with railings. While these devices may be suitable for the purposes for which they where designed, they would not be as suitable for the purposes of the present invention as heretofore described.

It is thus desirable to provide a plurality of positionable angled members forming a pet-safety guard It is further desirable to provide a pet-safety device having an extension member that when used in conjunction with one of the side angled members extends the length of one side of the pet-safety guard.

SUMMARY OF THE PRESENT INVENTION

A primary object of the present invention is to provide a pet-safety guard mountable to a bed to prevent pets from inadvertently falling off the bed.

Another object of the present invention is to provide a pet-safety guard having a plurality of angled members positionable between a mattress and a box spring.

Yet another object of the present invention is to provide a pet-safety device wherein each of said angled members forms a substantially right angle.

Still yet another object of the present invention is to provide a pet safety device having a planar base portion and a vertically extending planar portion.

Another object of the present invention is to provide a pet safety device having fasteners for releasably attaching the angled members together.

Yet another object of the present invention is to provide a pet-safety device optionally providing a side extension member.

Still yet another object of the present invention is to provide a pet-safety device wherein the vertically rise of the angled members extends above the planar surface of the bed's mattress.

Additional objects of the present invention will appear as the description proceeds.

The present invention overcomes the shortcomings of the prior art by providing a pet-safety guard comprising a plurality of angled members that are positionable between a bed's mattress and box spring to prevent a pet from falling off or of being accidentally pushed off a bed. The angled member positioned at the foot of the bed extends from one side to the other whether twin, queen or king sized mattress with the side angled members positioned on opposing sides of the bed with each adjacently fastened to the foot member by means of at least one bracket. The vertical portion of the angled members sufficiently extends above the planar top surface of the mattress to form a barrier to prevent the aforementioned accidents. The side angled members extend only partially toward the head of the bed thereby enabling individuals and pets to easily get into bed without having to climb over the pet-safety barrier.

Optionally, the present invention provides an extension angled member whereby the entire length of one side of the bed has the pet-safety guard therealong.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
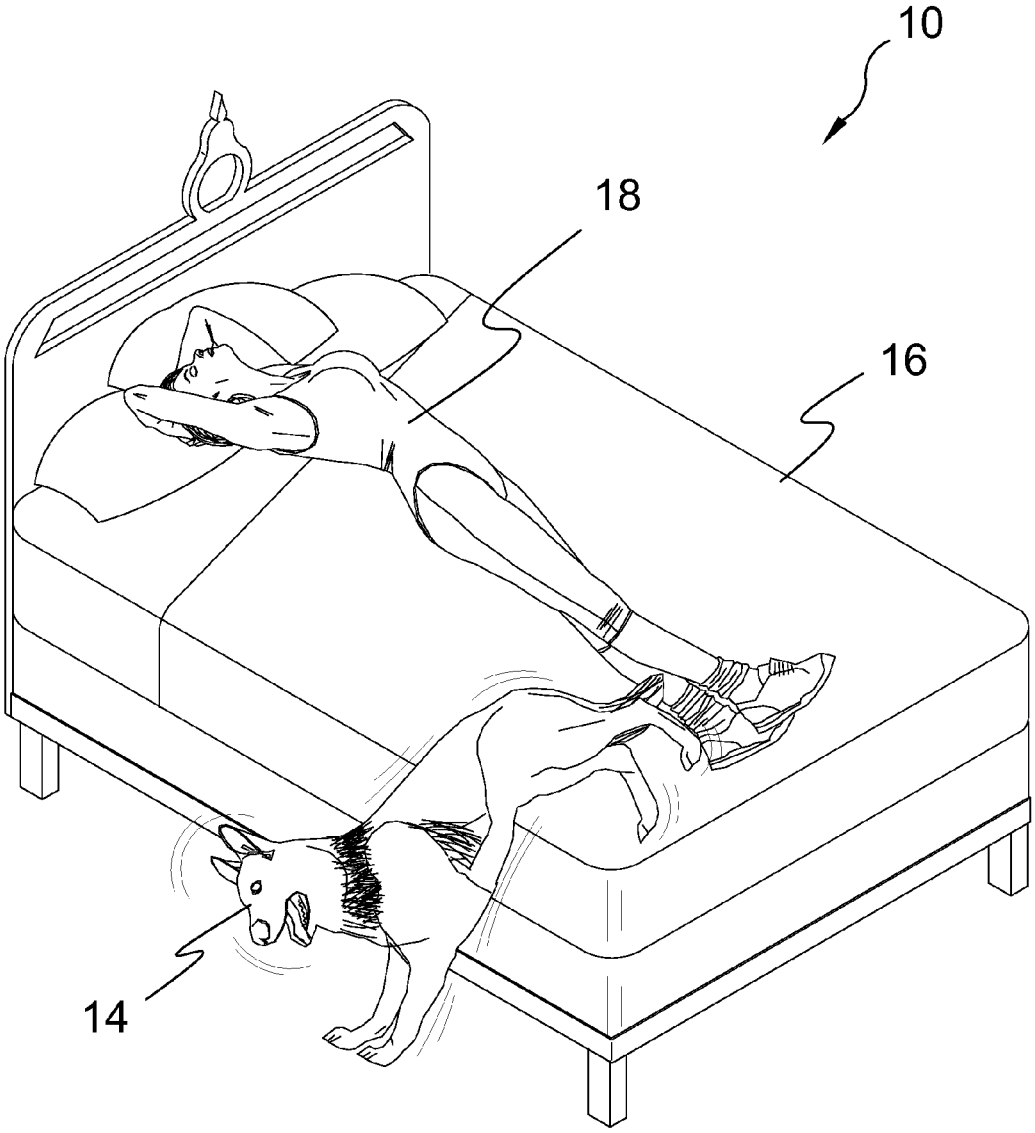
FIG. 1 is an illustrative view of prior art.

Turning now descriptively to the drawings, in which similar reference characters denote similar elements throughout the several views, the figures illustrate the Pet Safety Barrier of the present invention. With regard to the reference numerals used, the following numbering is used throughout the various drawing figures.

10 Pet Safety Barrier of the present invention
12 prior art
14 pet
16 bed
18 pet owner
20 mattress
22 box spring
24 right side wall
26 left side wall
28 foot end wall
30 right angle fastener bracket
32 wall base
34 vertical wall
36 mounting hardware
38 extension wall
40 linear fastener bracket
42 mitered base corner

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art 12. Many pet owners 18 allow their pets 14 to relax and sleep with them in bed 16 as an act of affirmation of affection, bonding and security. Unfortunately, the pet 14 is in danger of falling out of the bed 16 sustaining serious injury or worse. The present invention overcomes this problem by providing a pet guard that will assist in keeping the pet from falling out of the bed and continue the intimate relationship between owner and pet.

Figure 2:
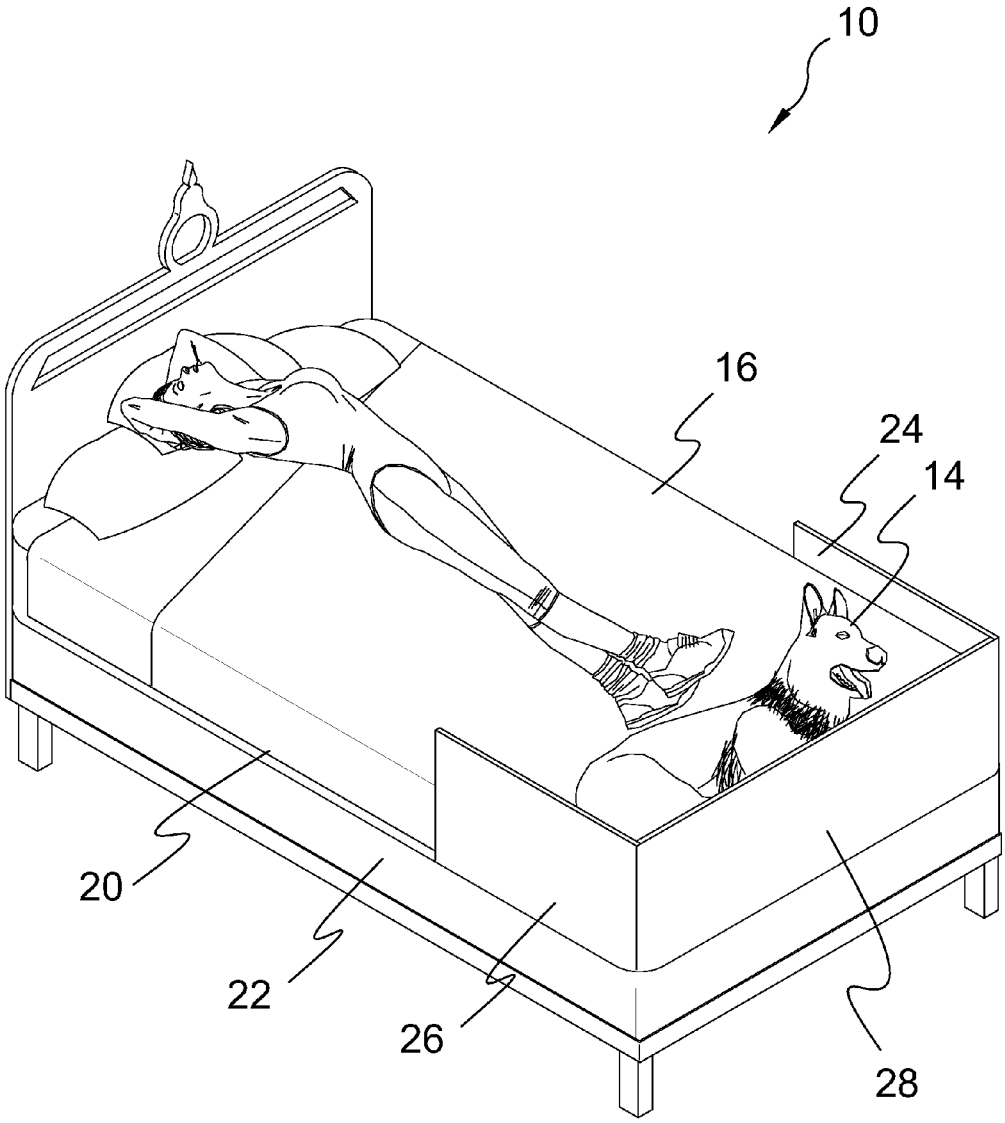
FIG. 2 is an illustrative view of the pet-safety barrier of the present invention in use.

FIG. 2 is an illustrative view of the pet-safety barrier 10 of the present invention in use. The present invention is a polymeric device, such as Plexiglas or similar material comprising a planar base with a vertically extending planar wall, preferably a single sheet bent into a substantially right angle, positionable between a bed's mattress 20 and box spring 22 along the foot and sides of a bed serving as a pet-safety guard. The vertical portion of the pet-safety guard extends above the height of the mattress 20 forming a barrier wall thereby keeping pets 14 from falling off the bed and injuring themselves. The side walls extend approximately one third of the distance from the foot of the bed to the headboard. Regardless of the size of the mattress 20, the foot end wall 28 extends from one side of the bed 16 to the other. The right side wall 24, left side wall 26 and foot end wall 28 are held together by fasteners, which are illustrated as angle brackets but other fasteners may be used serving similar purpose. The pet-safety barrier 10 can be of a transparent, translucent or opaque material and may incorporate a graphic design or pattern thereon. Each vertical wall 32 has a right angle base 32 that resides between the mattress 20 and the box spring 22.

Figure 3:
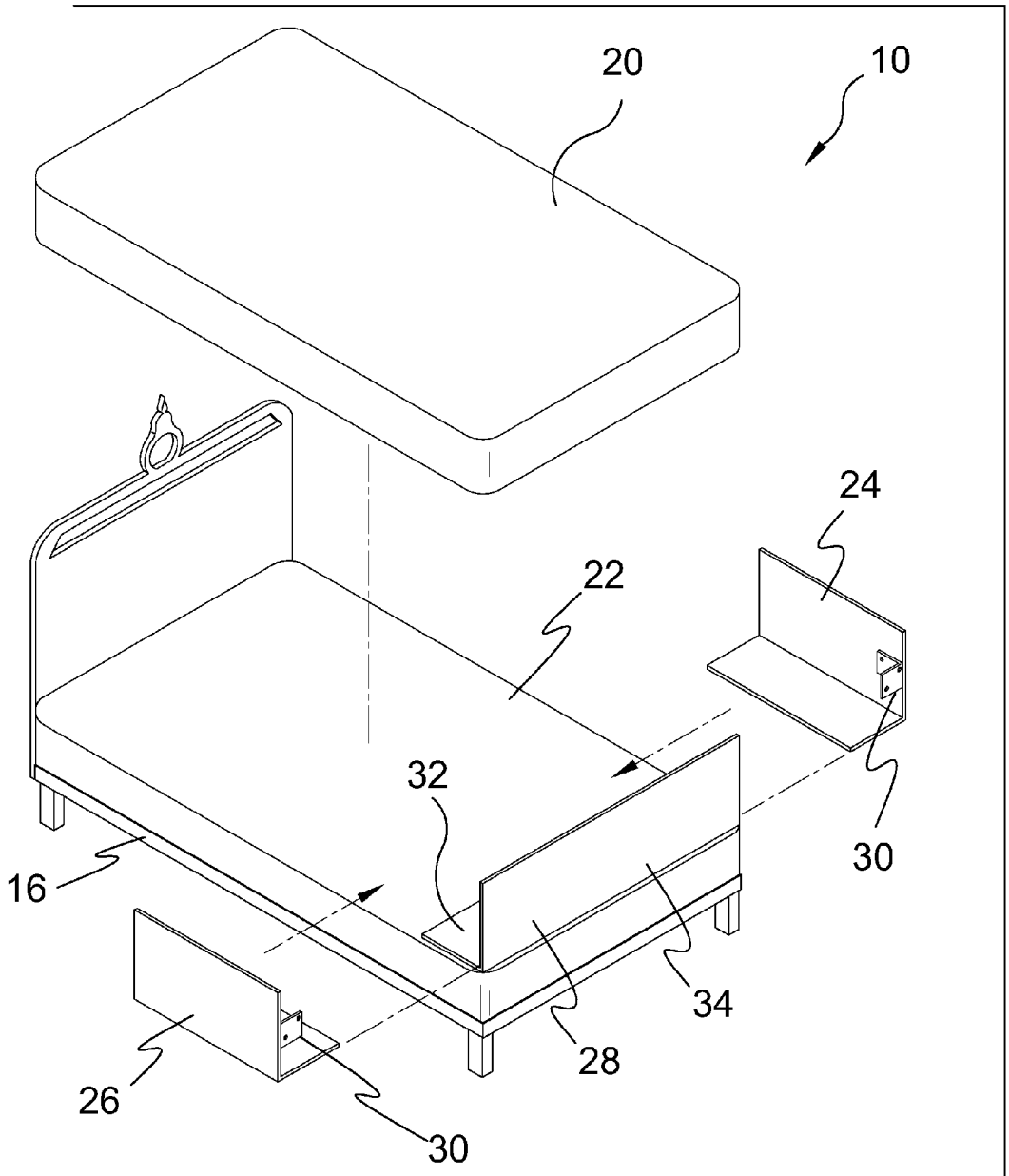
FIG. 3 is an exploded view of the pet-safety guard of the present invention.

FIG. 3 is an exploded view of the pet-safety guard 10 of the present invention. Shown is the pet-safety guard 10 comprising a plurality of angled members that are positionable between a bed's mattress 20 and box spring 22 to prevent a pet from falling off or of being accidentally pushed off a bed. The foot end wall 28 positioned at the foot of the bed 16 extends from one side to the other whether twin, queen or king sized mattress with the right side wall 24 and left side wall 26 positioned on opposing sides of the bed 16 with each adjacently fastened to the foot side wall 28 by means of at least one right angle bracket 30. The vertical portion of the angled members sufficiently extends above the planar top surface of the mattress 20 to form a barrier to prevent the aforementioned accidents. Also shown is the side angled members that extend only partially toward the head of the bed thereby enabling individuals and pets to easily get into bed without having to climb over the pet-safety barrier.

Figure 4:
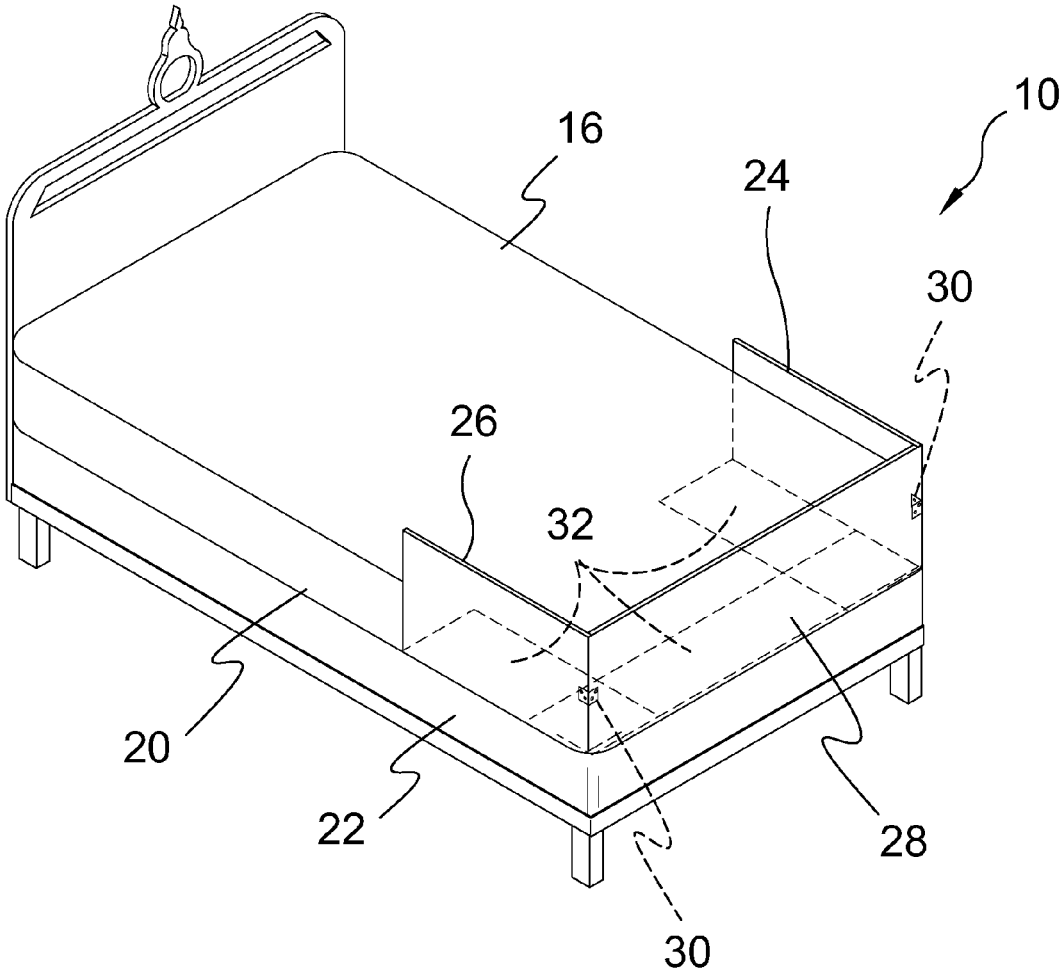
FIG. 4 is a perspective view of the pet-safety guard of the present invention in use.

FIG. 4 is a perspective view of the pet-safety guard 10 of the present invention in use. Depicted is the right side wall 24 and left side wall 26 secured to the foot end wall 28 by right angle fasteners 30 with the bases 32 disposed between the mattress 20 and box spring 22 of the bed 16.

Figure 5:
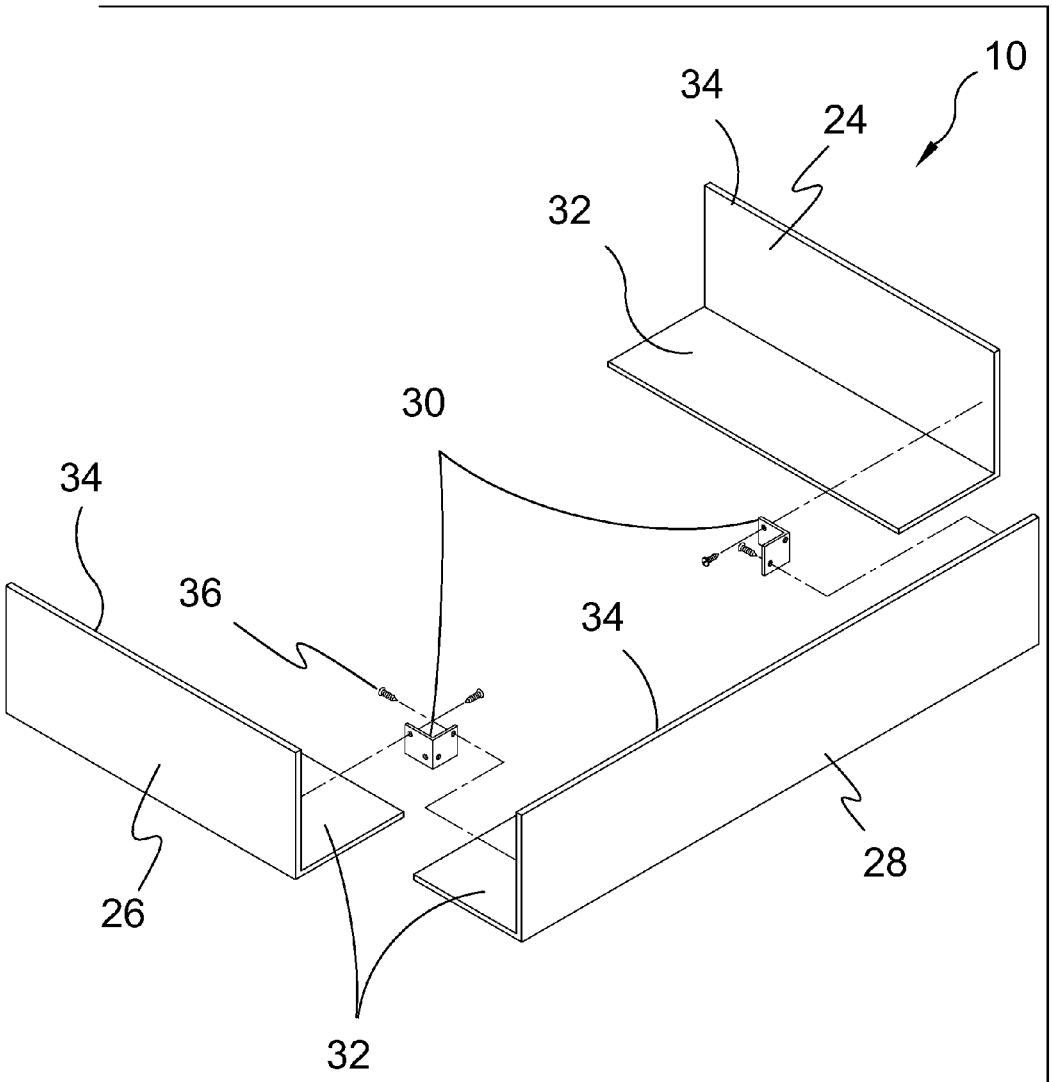
FIG. 5 is an exploded view of the pet-safety guard of the present invention.

FIG. 5 is an exploded view of the pet-safety guard 10 of the present invention. Depicted is an exploded view of the pet-safety guard comprising a foot end wall 28, right side wall 24 and left side wall 26 having substantially planar bases 32 with vertically depending walls designed to extend above the top planar surface of the mattress thereby forming the pet-safety guard. The right angled fastener brackets 30 are fastened to the vertical walls 34 by means of at least one fastener bracket 30 and mounting hardware 36 with provision for a plurality of fasteners depending on the mattress height, material type or material thickness selected for the pet-safety guard.

Figure 6:
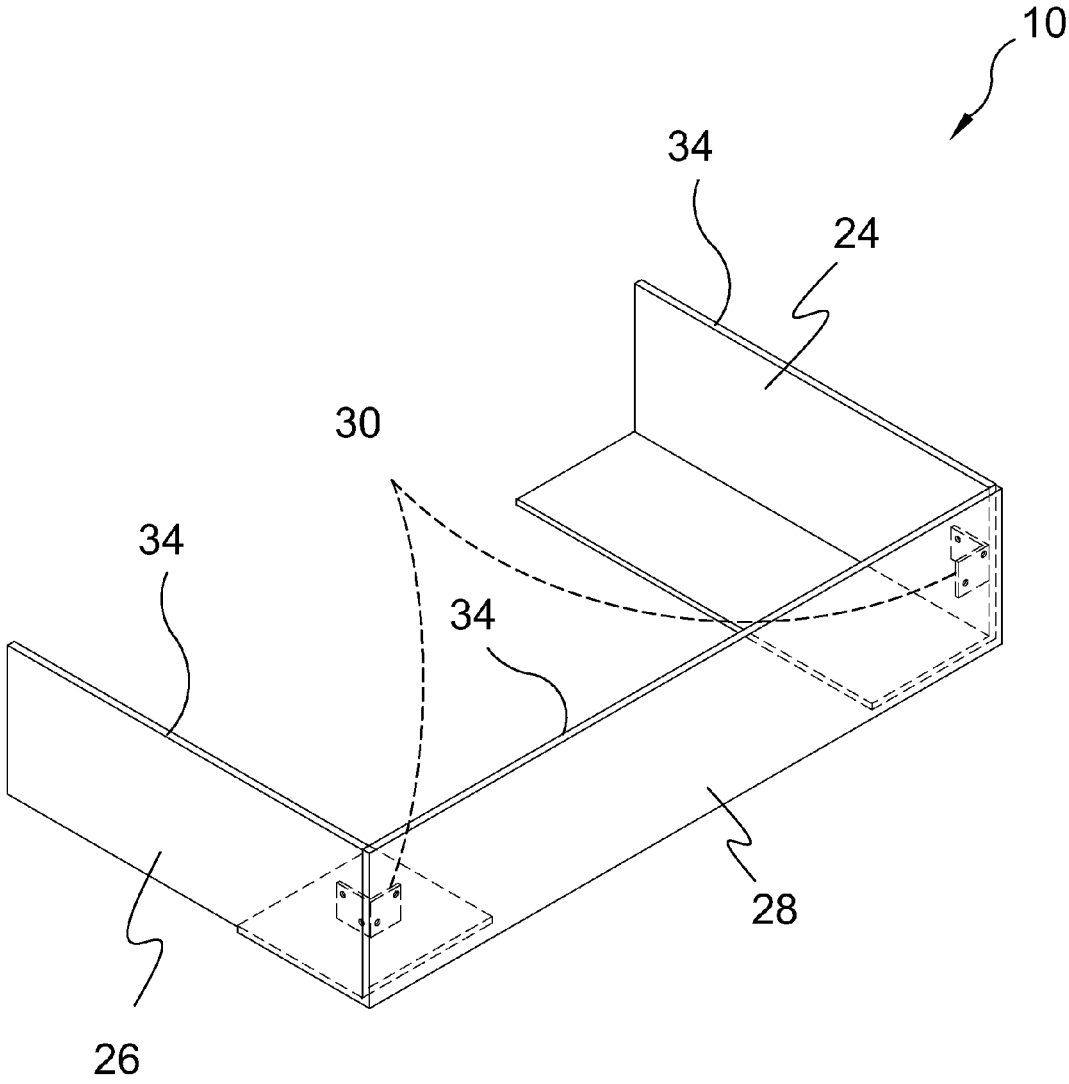
FIG. 6 is a perspective assembled view of the pet-safety guard of the present invention.

FIG. 6 is a perspective assembled view of the pet-safety guard 10 of the present invention. Depicted is an assembled view of the pet-safety guard 10 comprising a foot end wall 28, right side wall 24 and left side wall 26 with vertically depending walls designed to extend above the top planar surface of the mattress thereby forming the pet-safety guard. The right angled fastener brackets 30 are fastened to the vertical walls 34 by means of at least one fastener bracket 30.

Figure 7:
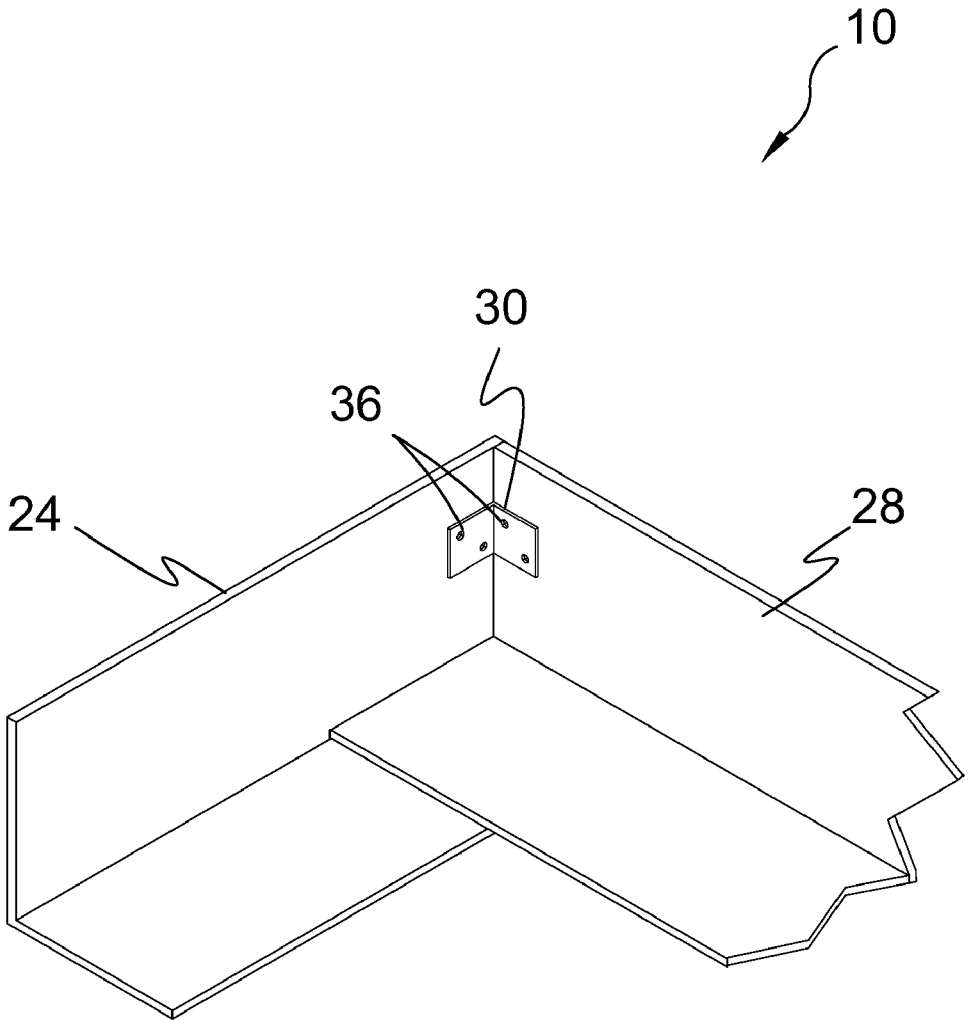
FIG. 7 is an enlarged partial view of the pet-safety guard of the present invention.

FIG. 7 is an enlarged partial view of the pet-safety guard 10 of the present invention. Shown is a partial view of the pet-safety guard 10 of the present invention having at least one fastener comprising a right angled bracket 30 and mounting hardware 36 with a correspondingly similar angle to the assembled foot end wall 28 and right side wall 24 with provision made by the present invention for a plurality of angle brackets or similar fastening hardware.

Figure 8:
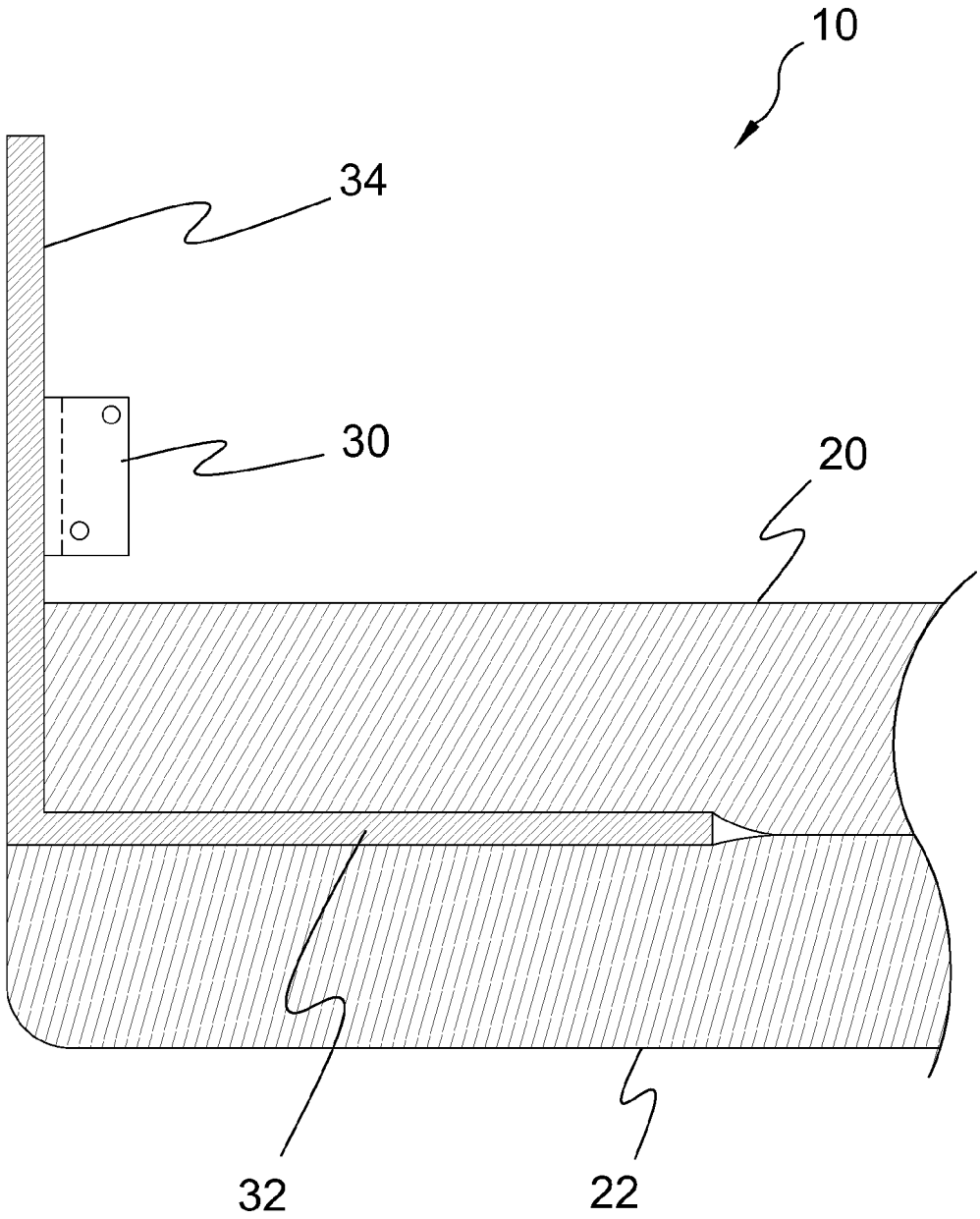
FIG. 8 is a sectional view of the present invention.

FIG. 8 is a sectional view of the present invention. Shown is a sectional view of the pet-safety guard 10 of the present invention comprising a plurality of angled member having a substantially 90 degree angle. The base portions 32 of the members are inserted between the mattress 20 and the box spring 22 at the foot and sides of a bed. The vertical wall 34 of the angled member extends above the height of the mattress forming a wall and protective barrier. The side portions extend approximately one third of the way from the foot portion of the bed to the headboard. The foot portion extends the entire width of the bed. The side portions and foot portion are attached with a correspondingly angled fastener brackets 30.

Figure 9:
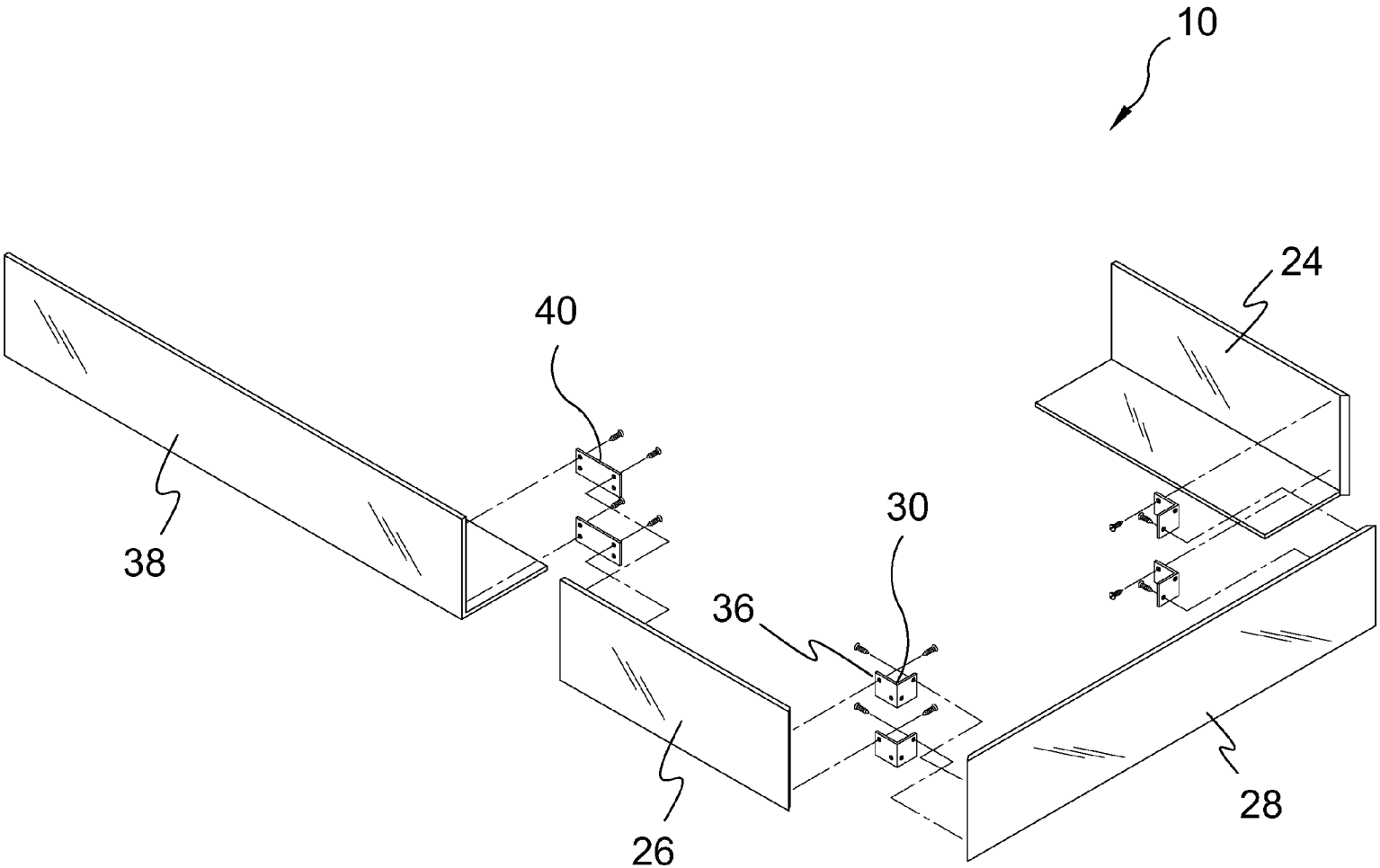
FIG. 9 is an exploded view of an additional element of the pet-safety guard of the present invention.
Figure 10:
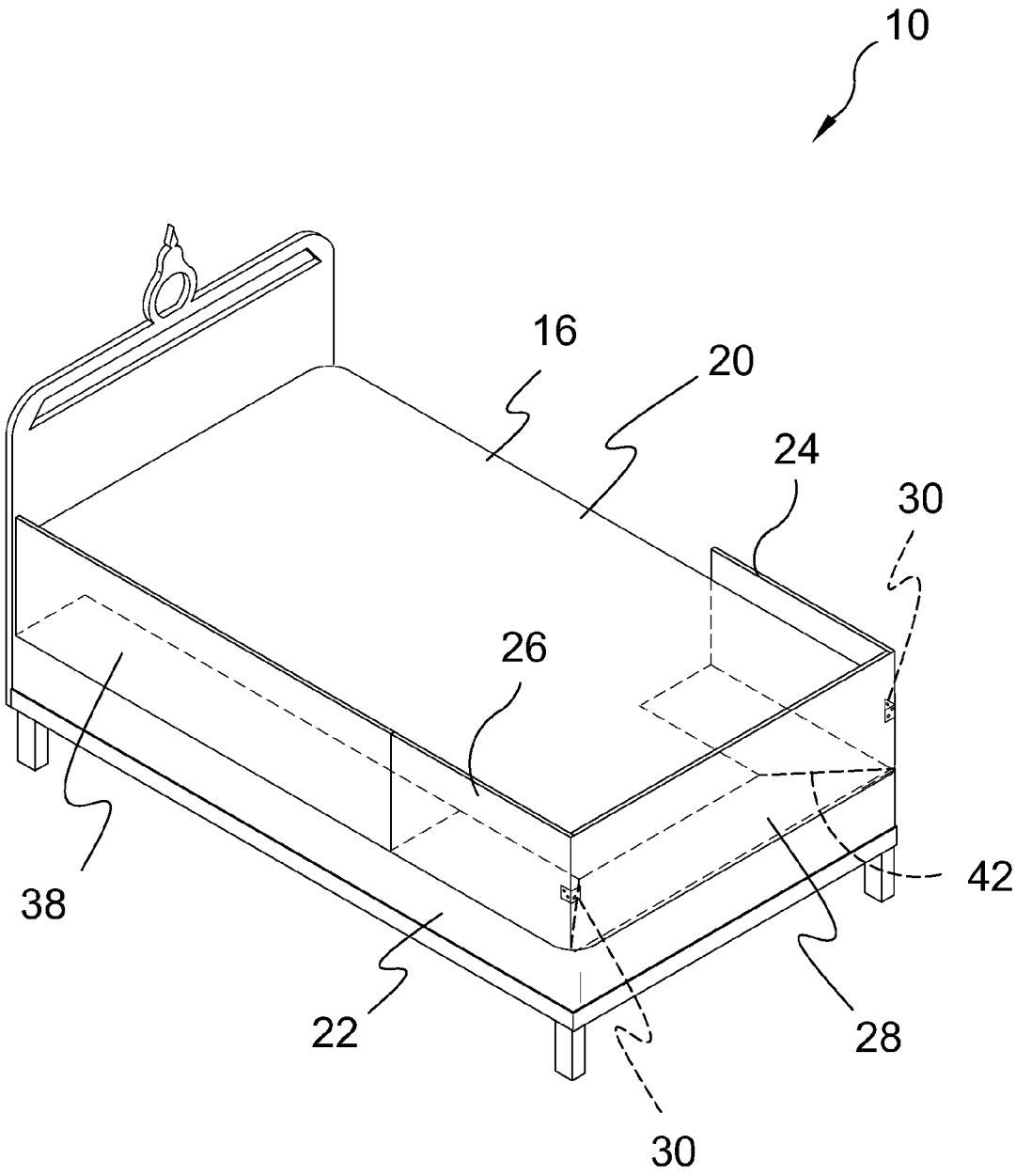
FIG. 10 is a perspective view of the present invention in use.

FIG. 9 is an exploded view of an additional element of the pet-safety guard 10 of the present invention. The present invention comprises a foot end wall 28, a right side wall 24 and a left side wall 26 having a substantially L-shape that are positionable between a bed mattress and box spring. Fasteners 30 and mounting hardware 36 are used to releasably secure the plurality of angled members together. The present invention further provides for an extension wall 38 with linear fastener brackets 40 whereby one side of the bed will have the pet-safety guard thereacross. Additionally provided for is an additional element comprising mitered mating edges between the foot angled member and the side members FIG. 10 is a perspective view of the present invention in use. Shown is the pet-safety guard 10 comprising a foot end wall 28, right side wall 24, left side wall 26 and extension wall 38 having a substantially right angle shape. The base 32 of the angle is inserted between the mattress 20 and the box spring 22 along the foot and sides of a bed. The vertical walls 34 extend above the height of the mattress 20 forming a wall and protective barrier, keeping pets from falling off the bed 16 and injuring themselves. The side portions extends approximately one third of the way from the foot portion of the bed towards the headboard. The foot portion completely covers the entire width of the bed. The side portions and foot portion are attached with angle brackets 30 or other device. The wall portions can be clear or have numerous designs and can be a straight pattern or contoured for aesthetics. Also provided is an extension member whereby one side of the bed will have the pet-safety guard therealong. Additionally provided for is an additional element comprising mitered base corners 42 mating edges between the foot angled member and the side members It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pet safety guard to prevent pets from inadvertently falling off of a bed comprising:

a) a plurality of right angled wall members having a base and a vertical wall depending therefrom;

b) a plurality of fastener elements for joining said right angled members to one another;

c) hardware for mounting said fastener elements to said right angled members; and d) said plurality of right angled members comprising a right side wall approximately one third of the length of a bed, a left side wall approximately one third of the length of a bed, and a foot end wall substantially equivalent to the width of the bed with which said pet safety guard is to be used.

2. The pet safety guard according to claim 1, wherein said mounting hardware is selected from the group of screws, bolt and nut and rivets.

3. The pet safety guard according to claim 1, wherein said walls are manufactured of a polymeric material.

4. The pet safety guard according to claim 3, wherein said polymeric material has properties selected from the group of transparent, translucent and opaque.

5. The pet safety guard according to claim 1, wherein said walls are available in a plurality of designs and patterns.

6. The pet safety guard according to claim 1, further comprising an extension wall for attachment to one of said sidewalls.

7. The pet safety guard according to claim 6, wherein said extension wall is secured to said side wall with at least one linear bracket.

8. The pet safety guard according to claim 6, wherein said extension wall effectively extends said vertical barrier along the entire length of said bed forming a substantially J-shaped footprint.

9. A pet safety barrier for beds to prevent a sleeping pet from falling off the bed when sleeping with the pet owner comprising:

a) a right angled polymeric foot end wall approximately equivalent to the width of a bed having a substantially planar base to reside between a mattress and a box spring and a substantially planar vertical wall of a height that rises substantially above the top of a mattress;

b) a right angled polymeric right side wall approximately one third of the length of the bed having a substantially planar base to reside between a mattress and a box spring and a substantially planar vertical wall of a height substantially equivalent to that of said foot end wall;

c) a right angled polymeric left side wall approximately one third of the length of the bed having a substantially planar base to reside between a mattress and a box spring and a substantially planar vertical wall of a height substantially equivalent to that of said foot end wall; and d) at least two right angle brackets and mounting hardware for securing said side walls to said foot end wall.

10. The pet safety barrier for beds as recited in claim 9, wherein said side walls are secured to said foot end wall with said right angle brackets and said mounting hardware.

11. The pet safety barrier for beds as recited in claim 10, wherein the bases of said walls are positioned between the mattress and box spring with said vertical walls rising above and flush with said mattress forming a substantially U-shaped barrier to prevent the sleeping pet from being pushed off the bed during movement of the owner.

12. The pet safety barrier for beds as recited in claim 9, further comprising an extension wall for attachment to one of said side walls with at least one linear bracket forming a substantially L-shaped barrier with one side extending for the entire length of the bed.

13. A pet safety guard to prevent pets from inadvertently falling off of a bed comprising:

a) a plurality of right angled wall members having a base and a vertical wall depending therefrom;

b) a plurality of fastener elements for joining said right angled members to one another;

c) hardware for mounting said fastener elements to said right angled members; and d) wherein said fastener elements are right angle brackets with mounting apertures.

14. The pet safety guard according to claim 13, wherein said right angled wall members comprise a right side wall and a left side wall secured to a foot end wall with at least one right angle bracket and mounting hardware at each corner forming a substantially U-shaped footprint.

15. The pet safety guard according to claim 14, wherein the base of each said wall is disposed between a mattress and box spring of said bed.

16. The pet safety guard according to claim 15, wherein said vertical wall of each said wall extends substantially beyond the top plane of the mattress to form a barrier to prevent a pet from inadvertently falling off the bed.

17. The pet safety guard according to claim 16, wherein the bases of said side walls and said foot end wall overlap to provide additional stability.

18. The pet safety guard according to claim 17, wherein the height of said vertical walls is slightly offset to compensate for the height differential created by said overlapping bases.

19. The pet safety guard according to claim 16, wherein the corner portions of said bases are mitered to sit flush with the adjacent base.

* * * * *